United States Patent [19]

Horikoshi et al.

[11] 4,443,323

[45] Apr. 17, 1984

[54] PROCESS FOR THE OIL EXTRACTION FROM OIL SAND BY USING CYCLODEXTRIN AND HYDROCARBON SOLVENTS

[75] Inventors: Koki Horikoshi, Tokyo, Japan; Ichiro Shibanai, No. 6-10-6-312, Akasaka, Minato-ku, Tokyo, Japan; Takashi Kato, Higashiyamato, Japan

[73] Assignees: Rikagaku Kenkyusho; Ichiro Shibanai, both of Wako, Japan

[21] Appl. No.: 523,688

[22] Filed: Aug. 16, 1983

[30] Foreign Application Priority Data

Aug. 20, 1982 [JP] Japan ..... 57-144385

[51] Int. Cl.[3] ..... C10G 1/00

[52] U.S. Cl. ..... 208/11 LE; 208/8 LE

[58] Field of Search ..... 208/11 LE, 8 LE

[56] References Cited

U.S. PATENT DOCUMENTS 4,255,249 3/1981 Shibanai et al. ..... 208/11 LE

*Primary Examiner*—Delbert E. Gantz
*Assistant Examiner*—A. Pal
*Attorney, Agent, or Firm*—Bucknam and Archer

[57] ABSTRACT

Process for the oil extraction from oil sand comprising: mixing oil sand, cyclodextrin, a hydrocarbon solvent, a flocculating agent and water with one another to prepare a suspension, leaving the suspension to stand or centrifuging it to separate into an oil, a water and a sand layer, and then collecting the oil layer.

24 Claims, 2 Drawing Figures

PROCESS FOR THE OIL EXTRACTION FROM OIL SAND BY USING CYCLODEXTRIN AND HYDROCARBON SOLVENTS

BACKGROUND OF THE INVENTION

1. Field of the Invention

This invention relates to a novel process for the oil extraction from oil sand by using cyclodextrin.

2. Description of the Prior Art

Processes for the oil extraction from sand oil known in the art include a process for the oil extraction in situ comprising introducing steam at high temperature and high pressure into a layer containing oil sand, that is, a steam separation process, and a process for separating oil from open-air oil sand by using alkaline water at an elevated temperature. However, these processes have an economical disadvantage since these need a great amount of energy. Recently, a new oil extraction has been proposed which utilizes an inclusion capability of cyclodextrin and comprises including oil molecule contained in oil sand within a cavity of cyclodextrin molecule and then separating the inclusion compound to collect oil (see U.S. Pat. No. 4,255,249). This process is economically better than the steam separation process described above and comprises forming an inclusion compound of oil and cyclodextrin, separating the resulting, water-insoluble inclusion compound by any suitable technique such as centrifugation, and then introducing the separated inclusion compound into hot water or subjecting it to steam distillation to collect oil. Thus, the new process requires a troublesome operation and takes a relatively long time. The oil extraction yield of this process is not good (generally about 60%) due to the troublesome operation. As described above, the process using an inclusion compound mentioned above is not suitable for an industrial production in view of yield, time and cost.

The inventors of the present invention have paid attention to a special physical property of cyclodextrin, that is, the fact that cyclodextrin has surface activity and also accelerates separation between oil and sand contained in oil sand, and have studied a process of oil extraction from oil sand by using cyclodextrin. The inventors have found that the oil extraction from oil sand may easily and effectively be conducted by mixing oil sand, cyclodextrin in such an amount that the formation of the inclusion compound between oil and cyclodextrin may substantially be avoided, and water with one another to prepare a suspension and leaving the suspension to stand or centrifuging it to separate an oil layer (see U.S. Ser. No. 394,581).

The inventors of the present invention have further studied the process described above and have found that the addition of a hydrocarbon solvent such as kerosene to the suspension increases in the oil extraction yield, the addition of a flocculating agent such as benzylidene sorbitol results in the quick clarification of the water layer separated, which makes it possible to recycle the clarified water in the process, and that the continuous production of cyclodextrin by passing a starch solution through a column packed with an immobilized enzyme provides a continuous process comprising the production of cyclodextrin and the separation of oil. The present invention is a result of the discoveries mentioned above.

SUMMARY OF THE INVENTION

An object of the present invention is to provide a process for the separation of oil from oil sand using cyclodextrin with a high yield.

Another object of the present invention is to provide a process for the separation of oil from oil sand, wherein the production of cyclodextrin and the separation of oil from oil sand are continuously carried out.

The above and other objects of the present invention are attained by a process for the oil extraction from oil sand comprising: mixing oil sand, cyclodextrin, a hydrocarbon solvent, a flocculating agent and water to prepare a suspension, leaving the suspension to stand or centrifuging it to separate into an oil, a water and a sand layer, and then collecting the oil layer.

According to a preferred embodiment of the present invention, a process for the oil extraction from oil sand is provided which comprises passing a starch hydrolyzate solution through a column packed with an immobilized cyclodextrin glycosyltransferase, diluting, if desired, the resulting solution of cyclodextrin with water, adding oil sand, a flocculating agent and hydrocarbon solvent to the cyclodextrin solution, mixing them to prepare a suspension, leaving the suspension to stand or centrifuging it to separate into an oil, a water and a sand layer, and then collecting the oil layer.

DETAILED DESCRIPTION OF THE INVENTION

Figure 1:
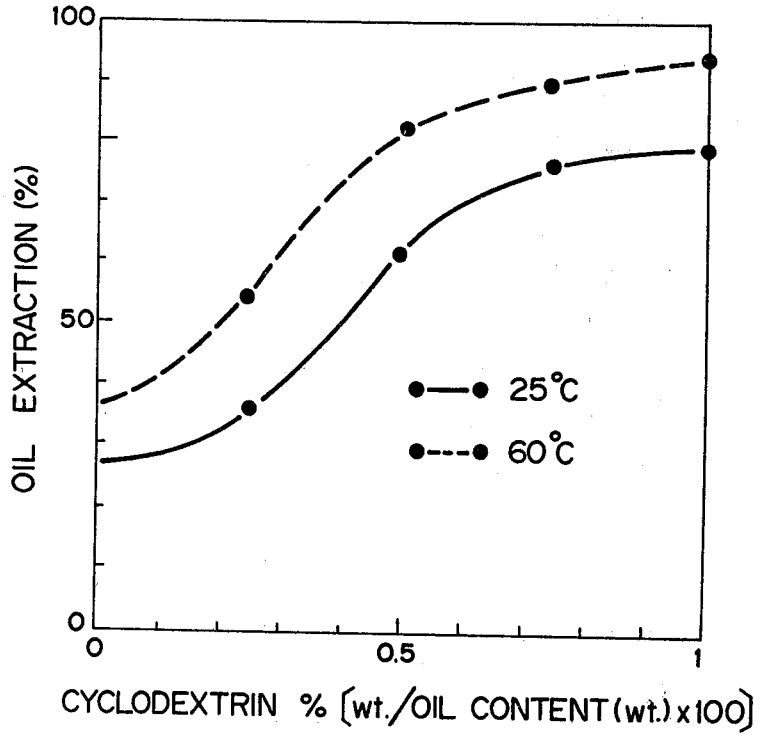
FIG. 1 is a graph showing a relationship between an oil extraction yield and a concentration of cyclodextrin in a solution used, wherein neither a hydrocarbon solvent nor a flocculating agent is added.

The terms "oil extraction yield" or "extraction yield" in the present specification means a percent by weight of an amount of extracted oil from oil sand based on an amount of oil contained in the oil sand.

The term "oil sand" in the present specification and the claims means any type of sands, stones and rocks containing oil such as oil sand, tar sand, oil shale, tailing water sludge and the like. These oil sands generally contain oil in an amount of from several to several tens percent by weight. Tar sand is a sand layer which generally contains tar in an amount of from 6 to 20 percent by weight. Heat treatment and simple prepurification of the tar gives an oil similar to normal crude oil. High quality oil shale is believed to contain hydrocarbon (shale oil) in an amount of more than 20 percent. The tailing water sludge is residue obtained after the oil extraction by the steam separation process described above and it normally contains oil in an amount of from about 6 to about 10 percent by weight.

Cyclodextrin used in the present invention is a special dextrin the molecular of which has a ring structure formed by a plurality of D-glucose molecules bonded each other by $\alpha$-1,4 glycosidic linkage. The interior of the cyclodextrin molecule is a cavity having a diameter of from about 6 Å to about 10 Å. It is known that various kinds of compound are included within the cavity to form an inclusion compound or a clathrate compound. There are several types of cyclodextrin which are classified by the number of D-glucose molecule constituting the cyclodextrin molecule. Among them, α-, β-, and γ-cyclodextrins the molecules of which consists of 6, 7 and 8 D-glucose molecules, respectively, are well known.

All types of cyclodextrins including α-, β- and γ-cyclodextrins described above may be used in the present invention. Cyclodextrin produced by a reaction between starch and the cyclodextrin glycosyltransferase produced by a microorganism which belongs to the genus Bacillus such as *Bacillus macerans, Bacillus circulans* and *Bacillus megaterium,* the genus Klebsiella or the genus Micrococcus, may also be used. In addition, cyclodextrin produced by a reaction between starch and the cyclodextrin glycosyltransferase produced by an alkalophilic bacteria ("alkalophilic bacteria" mean all of cyclodextrin glycosyltransferase-producing bacteria which grow under an alkaline condition but cannot or hardly grow under an acidic or neutral condition), may be used. It is preferred to use the latter cyclodextrin described which may be industrially produced with a very high advantage (see U.S. Pat. No. 3,923,598 and 4,135,977).

In addition to the crystalline cyclodextrin described above, a cyclodextrin-containing filtrate obtained by filtration of a solution containing precipitated crystalline cyclodextrin, or a cyclodextrin-containing solution obtained directly by a reaction between starch and the enzyme produced by a microorganism selected from the above group, may also be used in the present invention. The use of the above filtrate or the above cyclodextrin solution is economically advantageous as compared with the use of cyclodextrin which are commercially available. For example, as explained in Example hereafter, about one percent by weight cyclodextrin aqueous solution is prepared by an enzymatic reaction between starch and the enzyme produced by the alkalophilic bacteria, and then tar sand is directly added to the solution, so that the object of the present invention could be accomplished by continuous, single step without isolation of cyclodextrin.

It will be recognized that α-, β- and γ-cyclodextrins may be used singly or in combination with each other.

Typical Examples of a hydrocarbon solvent used in the present invention include such fraction as kerosene, naptha and light oil. Kerosene is most preferred.

Typical Examples of a flocculating agent used in the present invention include a low molecular flocculating agent such as condensates of sorbitol and benzaldehyde such as D-(1,3)(2,4)di-benzylidene sorbitol which is available from EC Chemical Industry under the tradename: CL 103 P, CP 103 P, A 103, AP 103, etc. and a high molecular polyacrylamide flocculating agent such as DIACLEAR (Mitsubishi Chemical Industry), SUMIFLOC (Sumitomo Chemical Company), KURIFLOC and KURIFIX (Kurita Water Industry), ARONFLOC (Toa Gosei Chemical Industry), ORFLOC and PRIMERFLOC (Japan Organo), KAYAFLOC (Nippon Kayaku), AQUAFLOC (Mitsubishi Cyanamid), SANFLOC (Sanyo Chemical Industries), SANPOLY (Sankyo Chemical Industry), KONANFLOC (Konan Chemical), HISET (Dai-ichi Kogyo Seiyaku), POLYLOC (Asada Chemical), MITSUMEFLOC (Naigai Chemical), UNIFLOCCUR (Unitika). D-benzylidene sorbitol of the following structure is preferred.

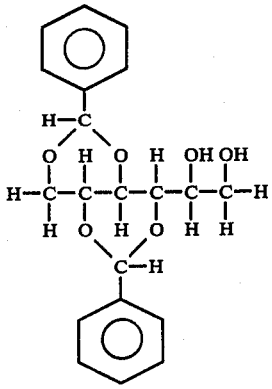

In the process of the present invention, it is believed that the use of the hydrocarbon solvent in combination with the flocculating agent increases in specific phycial properties of cyclodextrin such as a surface activity and a function of oil separation from oil sand using cyclodextrin. It is believed that kerosene, for instance, is reduced in its volatility by D-benzylidene sorbitol and accelerates the above functions of cyclodextrin to increase an oil extraction yield.

An amount of cyclodextrin used in the process of the present invention is generally in the range of 0.02 to 5, preferably from 0.03 to 2 percent by weight based on the amount of oil contained in oil sand by weight. FIG. 1 shows a relationship between an oil extraction yield and a cyclodextrin concentration wherein neither kerosene nor a flocculating agent is added. When cyclodextrin is used in the amount smaller than the lower limit, a sufficient oil extraction yield is not achieved. On the other hand, when it is used in the amount greater than the higher limit, the inclusion compound is formed, thereby a layer separation becomes incomplete, making an oil extraction yield lower and, at the same time this is disadvantageous from an economical point of view.

Figure 2:
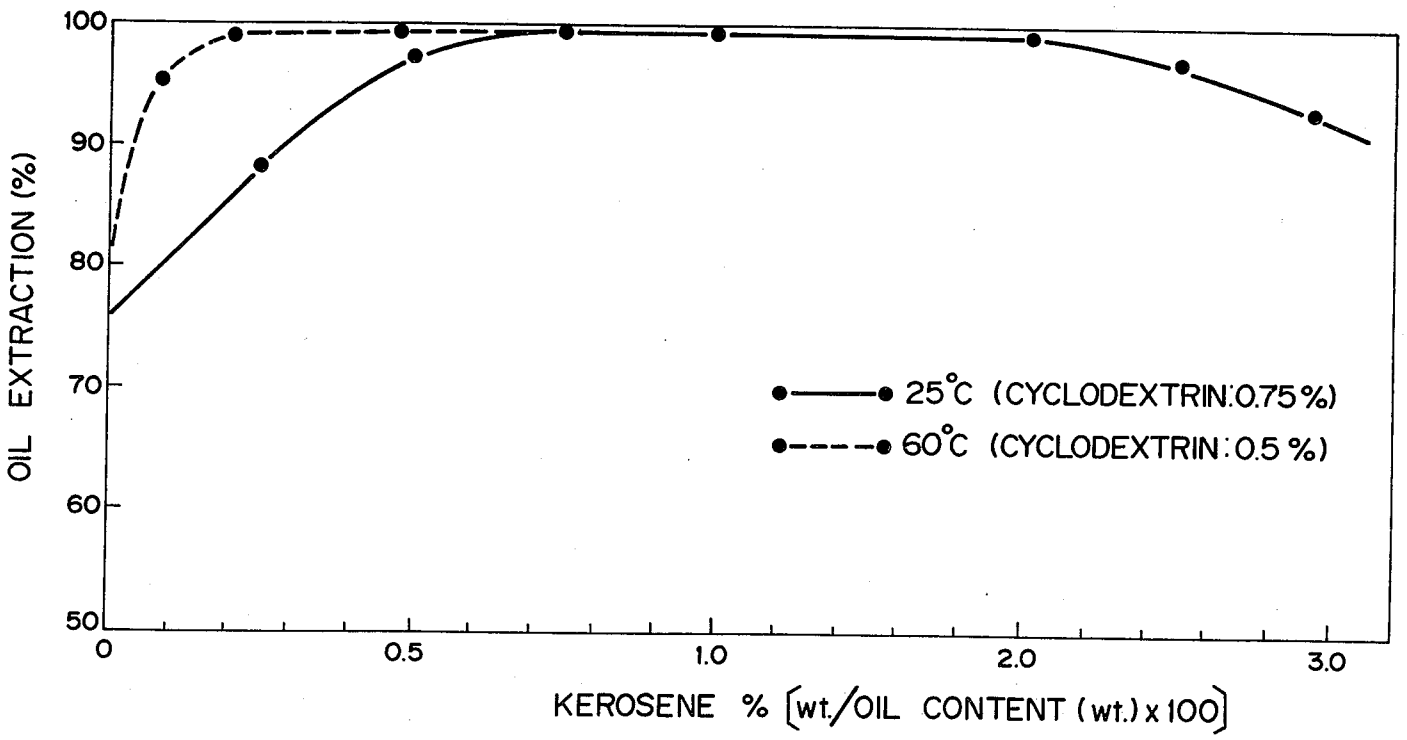
FIG. 2 is a graph showing a relationship between an oil extraction yield and an amount of kerosene used in combination with cyclodextrin.

A proper amount of the hydrocarbon solvent used is in the range of 0.1 to 2, preferably 0.5 to 1 percent by weight based on the oil content in oil sand. When the solvent is used in the amount lower than 0.1%, a sufficient extraction yield cannot be obtained. And when it is used in the amount higher than 2 percent by weight, the oil dispersion is formed in water, which constitutes an obstacle to the layer separation thereafter, and a sufficient effect in raising oil extraction yield cannot be obtained. Keeping the cyclodextrin concentration 0.75% (25° C.) or 0.5% (60° C.), without a flocculating agent, an oil extraction yield is determined in various concentrations of kerosene. The results are given in FIG. 2 which demonstrates that an oil extraction yield is remarkably increased by the addition of kerosene in the amount described above.

The flocculating agent has little affect on the oil extraction yield but it clarifies the separated water layer in a couple of days. An amount of the flocculating agent used is in the range of 0.1 to 2 percent by weight based on the amount of the hydrocarbon solvent used, that is, in the range of 0.0001 to 0.04 percent by weight based on the oil content in oil sand. Less than this range gives an insufficient clarification effect, while more than this range gives no more improvement in the effect.

As described above, α-, β- and γ-cyclodextrins used in the present invention are not limited to substantially pure or crystalline cyclodextrin. A mixture of more than one of these cyclodextrins, or those containing at least one of these cyclodextrins may also be used. For example, cyclodextrin-containing starch hydrolyzate obtained as a by-product in the production of cyclodextrin by a reaction between starch and a cyclodextrin glycosyltransferase obtained by a microorganism belonging to the genus Bacillus, or a filtrate obtained after removal of crystalline cyclodextrin by filtering the starch hydrolyzate, may also be used with an industrial advantage. Such starch hydrolyzate is, for example, commercially available from Nihon Shokuhin Kako, Co., Japan (sold under the name of Celdex CH-30 of which cyclodextrin content is 15% by weight).

A weight ratio of water to oil sand in the present invention is in the range of 1 to 7, preferably 1.5 to 5, most preferably 2 parts of water based on one part of oil sand. When water is used below the lower limit, it is hard to stir the mixture and the inclusion compound of oil and cyclodextrin may easily be formed. When the amount of water exceeds the upper limit, a larger system is required, which is uneconomical.

Oil sand, cyclodextrin, a hydrocarbon solvent, a flocculating agent and water may be added to a mixing vessel in any sequence and for example, cyclodextrin, the hydrocarbon solvent and the flocculating agent may be dissolved in water prior to the addition of oil sand. The above starch hydrolyzate may be used as it stands. The mixture is stirred to prepare a suspension. A temperature of the mixture and a time for stirring is not critical and may suitably be selected depending upon the amount of the mixture. The temperature may be in the range of from room temperature to 80° C., for example, 50° C. to 60° C., and the time may be in the range of from 0.5 to 10 hours, for example, 0.5 hour.

After stirring, the resulting suspension is left to stand for more than 30 minutes, for example 60 minutes and then it is separated into three layers of oil, water and sand. This layer separation is accelerated by heating and/or centrifuging the suspension. In this case, the suspension is preferably heated to above 80° C., especially above 100° C. for from 1 to 30 minutes, for example 5 minutes.

The layer separation step may be combined with the stirring step. Thus, the mixture may be heated to above 80° C. with stirring and thereafter may be left to stand or centrifuged.

The resulting uppermost oil layer may be separated and collected by any conventional technique. The following sheet shows one example of the process of the present invention.

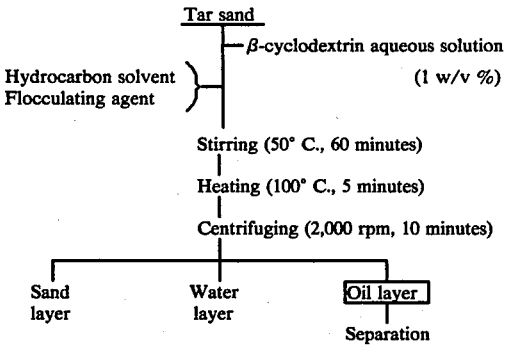

The resulting turbid water layer contains cyclodextrin and the flocculating agent so that the turbidity disappears in two or three days, after which the water layer may be recycled to the oil extraction process. Heating and centrifuging of the turbid water layer accelerate the elimination of the turbidity. If necessary, cyclodextrin, the hydrocarbon solvent, the flocculating agent and water are replenished and fresh oil sand is added thereto, then the above process is repeated so that the present invention may be continuously carried out without a substantial discharge of waste water.

As described above, the process of the present invention is directed to improve an oil extraction yield and a water reusability in the process as disclosed in U.S. Ser. No. 394,581 by the use of a hydrocarbon solvent and a flocculating agent. This oil extraction process may continuously be carried out from the cyclodextrin production to the oil separation by the use of a process in which a cyclodextrin containing solution is continuously produced by passing a starch hydrolyzate solution through a column packed with an immobilized cyclodextrin glycosyltransferase, at a temperature of 50° C. to 70° C. The immobilized enzyme is stable over the wide range of pH and temperature and it may repeatedly be used, which is very economical. The immobilized enzyme may be prepared by a conventional method such as an adsorption, an entrapment and a support binding method (see "Immobilyzed Enzyme" by I. Senhata, Kodansha Scientific, Japan, Nov. 1, 1975). For example, the enzyme is pretreated to be purified by the conventional adsorption method (see the reference above). An adsorbing resin is equilibrated to pH 8.5 with 10 mM Tris-HCl buffer and is packed in a column. A solution of 0.01–1.0 parts by weight of the pretreated enzyme in 1 to 5 parts of the buffer based on one part of the dry resin is passed through the column. The enzyme is adsorbed on the resin to form an immobilized enzyme. Examples of the resin on which the enzyme is immobilized include DIAION HP-10, 20, 30, 40, 50 (Tradename, highly porous styrene-divinylbenzene copolymer, Mitsubishi Chemical Industry Ltd., Japan), AMBERLITE XAD-2,4(Tradename, styrene-divinylbenzene copolymer) and AMBERLITE XAD-7,8(Tradename, acrylic acid ester polymer, Rohm & Haas Co. U.S.A.).

According to a preferred embodiment of the present invention, a process for the oil extraction from oil sand is provided which comprises passing a starch hydrolyzate solution through a column packed with an immobilized cyclodextrin glycosyltransferase to form a cyclodextrin containing solution, diluting, if desired, the solution with water, adding to the solution oil sand, a flocculating agent, and a hydrocarbon solvent, stirring the mixture to prepare a suspension, leaving the suspension to stand or centrifuging it to separate into an oil, a water and a sand layer, and collecting the oil layer. A specific example of the process above is illustrated in the following flow sheet.

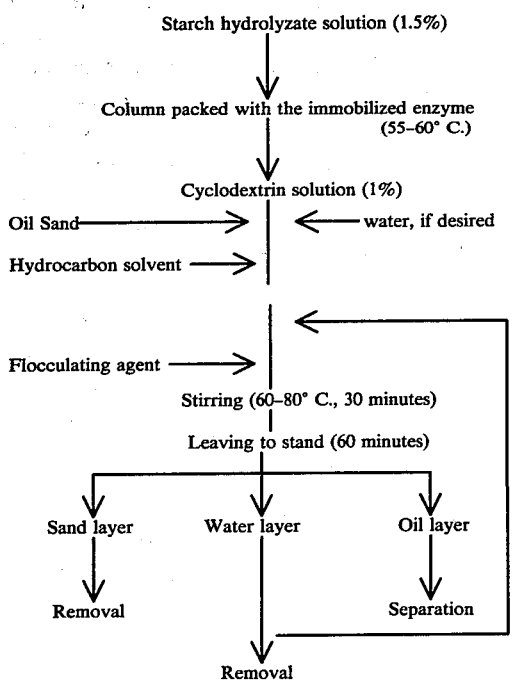

In this process, more concentrated starch hydrolyzate solution, for example, 10 to 20% by weight of a liquefied starch solution may be passed through the column. Such high concentration of the liquefied starch solution also gives cyclodextrin in a high yield (about 50 to 60%) and therefore it is quite economical.

The starch hydrolyzate solution may be passed through the column at a rate of SV 0.05 to SV 0.5, wherein the column temperature is maintained at 50° C. to 70° C., preferably 55° C. to 60° C. When the column temperature is below the lower limit, there is a possibility of the contamination of various bacteria or the like, which leads to a reduction in the cyclodextrin production. When the temperature is above the higher limit, there is a possibility of an inactivation of the enzyme or a separation of the enzyme from the resin. The cyclodextrin aqueous solution thus obtained is diluted, if desired, and used for the oil extraction process.

As stated above, the present invention provides a process for the oil extraction from oil sand using cyclodextrin, characterized by that a hydrocarbon solvent is added to a cyclodextrin solution to achieve substantially complete extraction of oil (more than 98% of the extraction yield), that a flocculating agent is added to the solution to eliminate in a couple of days the turbidity of the water layer separated, and that a column packed with an immobilized enzyme is used to achieve a continuous process from the cyclodextrin production to the oil separation without the isolation of cyclodextrin.

The present invention will now be explained in the following Examples.

EXAMPLE 1

Cyclodextrin glycosyltransferase (2 g) produced by *Bacillus SP. No.* 38–2 (ATCC 21783) and treated and purified by a starch adsorption method was passed through a column (30 mm $\phi \times 110$ mm) packed with 70 ml of DIAION HP-20 (Mitsubishi Chemical Industry, highly porous styrene-divinylbenzene copolymer) to prepare an immobilized enzyme. A starch hydrolyzate solution (1.5 w/v %, pH 7–8) was passed through the column at a rate of SV 0.4. The column temperature was maintained at 55° C. to 60° C. Being passed through the column, the starch hydrolyzate was converted to cyclodextrin to give about one percent by weight of cyclodextrin solution to which D-benzylidene sorbitol (a molar ratio=2:1, solid content 50%) (0.1 wt % based on the oil content), kerosene (1 wt % based on the oil content), oil sand produced in Canada (10 g, 13% of oil content) and water were added to give 30 ml of a mixture which contained 1 wt % of cyclodextrin based on the oil content.

The mixture was heated to 60° C.–80° C. and stirred for about 30 minutes, then the mixture was left to stand for about 60 minutes. The mixture was separated into an oil, a water and a sand layer. The oil layer was separated to give 1.290 g of oil (extraction yield: 99.2%). The water layer was clear and can be reused as it stands.

EXAMPLE 2

The procedures of Example 1 were repeated except that the enzyme produced by *Bacillus macerans* (IFO 3490) instead of *Bacillus SP. No.* 38–2 was used. 1.285 g of oil (extraction yield: 98.8%) was separated.

EXAMPLE 3

The procedures of Example 1 were repeated except that the enzyme produced by *Bacillus SP. No.* 17–1 (ATCC 31007) instead of *Bacillus SP. No.* 38–2 was used. 1.294 g of oil (extraction yield: 99.5%) was separated.

EXAMPLE 4

The procedures of Example 1 were repeated except that a polyacrylamide flocculating agent (AQUAFLOC: Mitsui Cyanamid, solid content 50 wt %) was used instead of D-benzylidene sorbitol. 1.274 g of oil (extraction yield: 98.0%) was separated. The water layer was clear and can be reused as it stands.

COMPARATIVE EXAMPLE 1

The procedures of Example 1 were repeated except that kerosene was not added. Extracted oil was reduced to 1.250 g (extraction yield: 96.2%). The water layer separated was clear and can be reused.

COMPARATIVE EXAMPLE 2

The procedures of Example 1 were repeated except that D-benzylidene sorbitol was not added. The oil extraction yield was as good as in Example 1 but the water layer separated was turbid so that it could neither be reused nor be discharged into a river without any treatment.

COMPARATIVE EXAMPLE 3

The procedures of Example 1 were repeated except that both kerosene and D-benzylidene sorbitol were not added. The oil extraction yield was 95%.

What we claim is:

1. A process for the oil extraction from oil sand, which comprises mixing oil sand, cyclodextrin, a hydrocarbon solvent, a flocculating agent and water with one another to prepare a suspension, leaving the suspension to stand or centrifuging it to separate into an oil, a water and a sand layer, and then collecting the oil layer.

2. The process as defined in claim 1 wherein the hydrocarbon solvent is selected from the group consisting of kerosene, naphtha and light oil.

3. The process as defined in claim 1 wherein the flocculating agent is selected from the group consisting of sorbitol/benzaldehyde condensates and polyacrylamides.

4. The process as defined in claim 1 wherein the cyclodextrin is used in an amount of from 0.02 to 1% by weight based on the oil content of the oil sand.

5. The process as defined in claim 1 wherein the hydrocarbon solvent is used in an amount of from 0.1 to 2% by weight based on the oil content of the oil sand.

6. The process as defined in claim 1 wherein the flocculating agent is used in an amount of from 0.1 to 2% by weight based on the weight of the hydrocarbon solvent.

7. The process as defined in claim 1 wherein the water is used in an amount of from 100 to 700% by weight based on the weight of the oil sand.

8. The process as defined in claim 1 wherein the mixing is carried out at a temperature of from 50° C. to 80° C.

9. The process as defined in claim 1 wherein the layer separation is carried out at a temperature above 80° C.

10. The process as defined in claim 1 wherein the water layer separated is recycled to the mixing step.

11. A process for the oil extraction from oil sand, which comprises mixing oil sand, 0.02 to 1% by weight of cyclodextrin based on the oil content of the oil sand, 0.1 to 2% by weight of a hydrocarbon solvent based on the oil content of the oil sand, 0.1 to 2% by weight of a flocculating agent based on the weight of the hydrocarbon solvent, and 100 to 700% by weight of water based on the weight of the oil sand, at a temperature of from 50° C. to 80° C. to prepare a suspension, heating the suspension to a temperature of from 80° C. to 100° C., leaving the suspension to stand or centrifuging it to separate into an oil, a water and a sand layer, and then collecting the oil layer.

12. A process for the oil extraction from oil sand which comprises passing a starch hydrolyzate solution through a column packed with an immobilized cyclodextrin glycosyltransferase to prepare a cyclodextrin solution, diluting, if desired, the cyclodextrin solution with water, mixing the cyclodextrin solution with oil sand, a flocculating agent and a hydrocarbon solvent to prepare a suspension, leaving the suspension to stand or centrifuging it to separate into an oil, a water and a sand layer, and then collecting the oil layer.

13. The process as defined in claim 12 wherein the hydrocarbon solvent is selected from the group consisting of kerosene, naphtha and light oil.

14. The process as defined in claim 12 wherein the flocculating agent is selected from the group consisting of sorbitol/benzaldehyde condensates and polyacrylamides.

15. The process as defined in claim 12 wherein the cyclodextrin is used in an amount of from 0.02 to 1% by weight based on the oil content of the oil sand.

16. The process as defined in claim 12 wherein the hydrocarbon solvent is used in an amount of from 0.1 to 2% by weight based on the oil content of the oil sand.

17. The process as defined in claim 12 wherein the flocculating agent is used in an amount of from 0.1 to 2% by weight based on the weight of the hydrocarbon solvent.

18. The process as defined in claim 12 wherein the water is used in an amount of from 100 to 700% by weight based on the weight of the oil sand.

19. The process as defined in claim 12 wherein the mixing is carried out at a temperature of from 50° C. to 80° C.

20. The process as defined in claim 12 wherein the layer separation is carried out at a temperature above 80° C.

21. The process as defined in claim 12 wherein the column is maintained at a temperature of from 50° C. to 70° C.

22. The process as defined in claim 12 wherein the water layer separated is recycled to the mixing step.

23. The process as defined in claim 12 wherein the cyclodextrin glycosyltransferase is a cyclodextrin glycosyltransferase produced by an alkalophilic bacteria.

24. A process for the oil extraction from oil sand, which comprises passing a starch hydrolyzate solution at a rate of SV 0.05 to 0.5 through a column maintained at a temperature of from 50° C. to 70° C. and packed with an immobilized cyclodextrin glycosyltransferase to prepare a cyclodextrin solution; diluting, if desired, the cyclodextrin solution with water; mixing the cyclodextrin solution with oil sand, a flocculating agent, and a hydrocarbon solvent at a temperature of from 50° C. to 80° C. to prepare a suspension, wherein the cyclodextrin is used in an amount of from 0.02 to 1% by weight based on the oil content of the oil sand, the hydrocarbon solvent is used in an amount of from 0.1 to 2% by weight based on the oil content of the oil sand, the flocculating agent is used in an amount of from 0.1 to 2% by weight based on the amount of the hydrocarbon solvent, and the water is used in an amount of from 100 to 700% by weight based on the weight of the sand; leaving the suspension to stand or centrifuging it to separate into an oil, a water and a sand layer, and then collecting the oil layer.

* * * * *